US005208926A

United States Patent [19]

Stackhouse

[11] Patent Number: 5,208,926

[45] Date of Patent: May 11, 1993

[54] BEDDING FOR CHILDREN

[76] Inventor: Elizabeth A. Stackhouse, 1915 SW. 67 Ter., North Lauderdale, Fla. 33301

[21] Appl. No.: 908,337

[22] Filed: Jul. 6, 1992

[51] Int. Cl.[5] ..... A47G 9/04; A47G 9/02

[52] U.S. Cl. ..... 5/482; 5/496

[58] Field of Search ..... 5/482–502

[56] References Cited

U.S. PATENT DOCUMENTS

| | | | |
|---|---|---|---|
| 3,179,958 | 4/1965 | Carris | 5/502 |
| 3,654,646 | 4/1972 | McMahon, Jr. | 5/482 |
| 3,920,012 | 11/1975 | Patel | 128/134 |
| 3,965,504 | 6/1976 | Ainsworth | 5/502 |
| 4,488,323 | 12/1984 | Colburn | 5/496 |
| 4,615,061 | 10/1986 | Scott | 5/497 |
| 4,631,765 | 12/1980 | Casey | 5/502 |
| 4,802,250 | 2/1989 | Farr | 5/482 |
| 4,934,939 | 6/1990 | Bonneville | 5/482 |
| 5,070,561 | 12/1991 | Keidser | 5/482 |

FOREIGN PATENT DOCUMENTS

| | | | |
|---|---|---|---|
| 1445600 | 6/1966 | France | 5/496 |

*Primary Examiner*—Alexander Grosz

[57] ABSTRACT

Bedding for a child's bed is provided with emblems arranged along the sides. The emblems may be of various shapes and colors. Matching emblems are located at the same relative positions on each layer of bedding. The child is taught to arrange each layer of bedding correctly upon the underlying layer by matching the emblems. The emblems may also be provided with engaging means such as hooks, snaps or hook and loop fasteners to maintain each layer in place on the lower layer of bedding.

8 Claims, 1 Drawing Sheet

FIG. 2
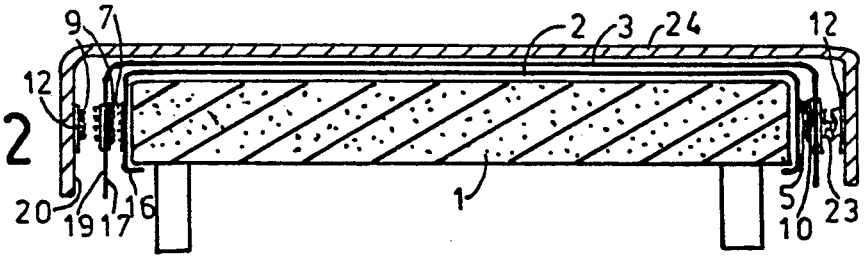
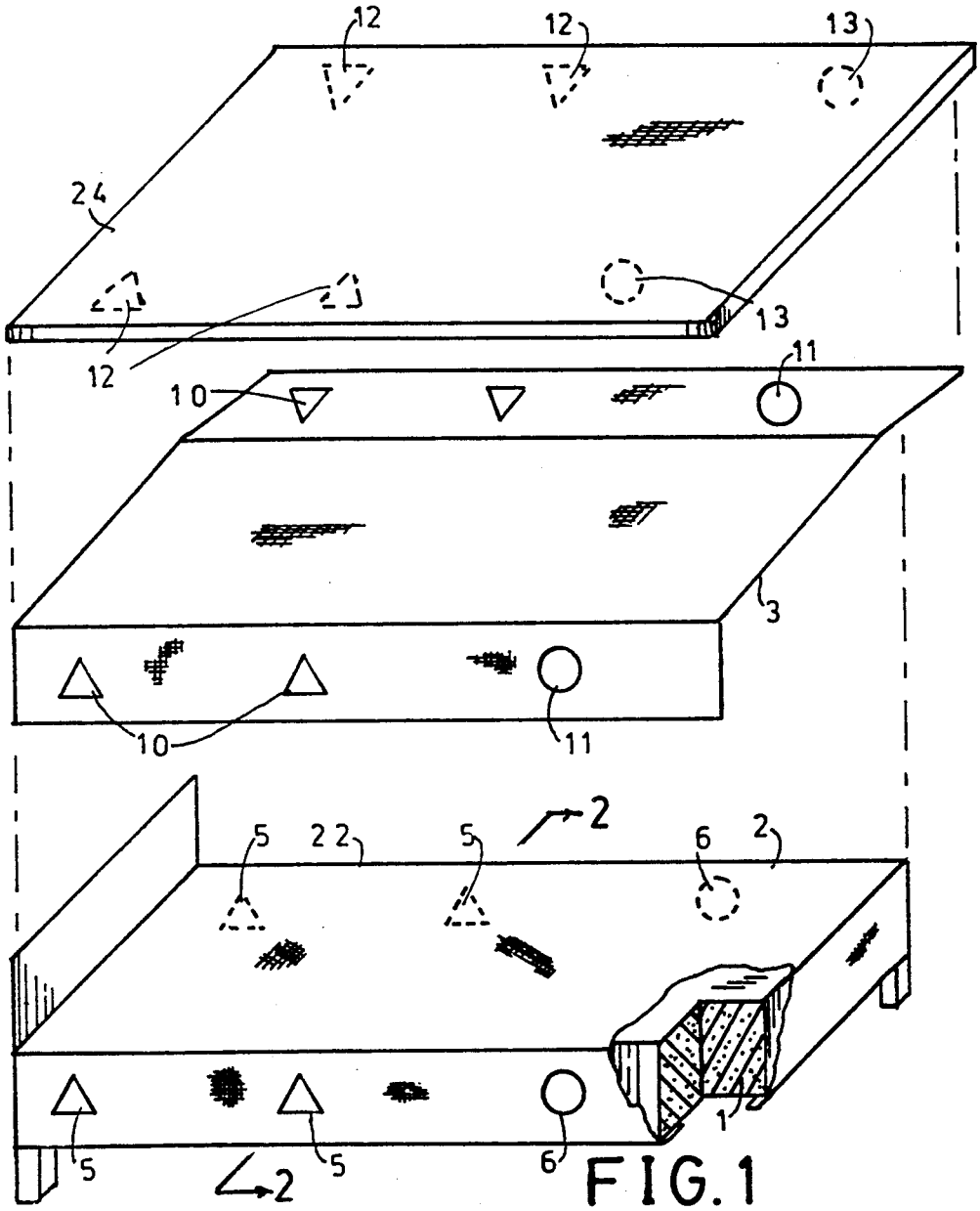
FIG. 1

BEDDING FOR CHILDREN

This application discloses subject matter found in patent application Ser. No. 07/488,261 filed Mar. 5, 1990 now abandoned.

This invention relates to bedding and more particularly to bedding arranged to teach children to make their beds.

BACKGROUND OF THE INVENTION

Making children's beds daily is a chore that is best assigned to the children as soon as possible to reduce housekeeping duties of adults. However, young children are not easily taught such a task and may rebel at doing work. Consequently, the chore may not be assigned until the child is quite mature. In the interim, the child has lost the opportunity to learn a challenging mental and physical task as well as the social experience of contributing to the upkeep of the household.

SUMMARY OF THE INVENTION

It is accordingly an object of the invention to provide bedding for a child's bed that is easier for a child to arrange than ordinary bedding. It is yet another object to provide bedding that will educate the child and provide a play element in the bed making process to encourage performance of the chore and reduce the housekeeping burden of others.

The bedding of the invention includes a bottom sheet having various emblems arranged along the sides, and a top sheet having corresponding emblems arranged along the sides in a similar position so that when the top sheet is arranged with its emblems aligned with the corresponding emblems of the bottom sheet, the bedding is properly arranged, that is the bed is made. The emblems may be provided with attaching means such as hook and loop connectors or snaps to maintain the position of the sheet when the emblems have been aligned to further facilitate the operation.

The child is first taught to arrange the top sheet on the bottom sheet after the adult has arranged the bottom sheet on the mattress. A blanket, bedspread or the like, may also be provided with the emblems. The emblems may be of varied colors as well as shapes to teach matching of colors as well as shapes.

Because there are many toys with both shape and color matching operations, the child is more likely to consider bed making as play rather than work when it incorporates these operations.

These and other objects, advantages and features of the invention will become more apparent when the detailed description is considered in conjunction with the following drawings.

BRIEF DESCRIPTION OF THE DRAWINGS

FIG. 1 is an exploded perspective view of the bedding of the invention in use with a portion broken away.

FIG. 2 is a sectional view taken through the line 2—2 of FIG. 1 with bedding of the invention in place.

DETAILED DESCRIPTION OF THE PREFERRED EMBODIMENT

Referring now first to FIG. 1, a mattress 1 is covered by a fitted bottom sheet 2 of the invention which is unique in that it bears a set of emblems consisting of triangles 5 and circles 6 arranged along the two sides 21 and 22. Those emblems on the side 22 away from the viewer and obscured by the mattress are shown in phantom.

The child is taught to cover the mattress with the fitted bottom sheet 2 with the emblems 5 and 6 along the two sides. Then the child is shown how to arrange the top sheet 3 so that the emblems 10 and 11 thereon are applied to the corresponding emblems 5 and 6 on the bottom sheet with triangles on matching triangles and circles on matching circles. As best seen in FIG. 2, the emblem 5 on the outer surface 16 of the bottom sheet is provided wit the hook portion 7 of a hook and loop fastener and the emblem 10 on the underside 17 of top sheet 3 is provided with the loop portion 9 of a hook and loop fastener so that the sheet is easily held in place at each matching emblem as the child is making the bed. In like manner, emblems 12 and 13 on the under surface 20 of the comforter or blanket 24 are applied to the matching emblems on the upper surface 19 of the top sheet, and once again the hook and loop fasteners hold the layers in place. The indicia may be applied by sewing on die-cut parts, imprinting, or other means well known in the art.

Snaps 23 or other fastener means well known in the art may be substituted for the hook and loop fasteners as desired.

It is expected that the bottom sheet may be applied by an adult until the child has mastered the easier task of arranging the upper layers. The indicia or emblems may be of various shapes such as fruit and animal shapes and of bright colors to provide a pleasant appearance and to teach recognition of shapes and colors. The invention further provides a useful teaching device and would be a desirable gift item of bedding that should be purchased in a set.

The above disclosed invention has a number of particular features which should preferably be employed in combination although each is useful separately without departure from the scope of the invention. While I have shown an described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A bedding for a child's bed having a central longitudinal axis adapted for use on and alignment with foot, head an sides of a rectangular mattress having a central longitudinal axis to facilitate making of abed by a child, said bedding comprising:

a) a plurality of substantially rectangular sheets of material, each defining head and foot ends that may be interchangeable and a pair of side edges for disposition along said sides of said mattress substantially parallel to said longitudinal axis;

b) a plurality of spaced-apart graphic emblems or figures of distinctive shapes at least some of which differ from one another and selected for ease of recognition by a child, all said emblems affixed adjacent each of said side edges, said emblems so arranged in corresponding positions on each said sheet that alignment of each particular graphic emblem of one sheet upon its matching emblem on a lower sheet properly arranges said sheets to make the bed.

2. The bedding according to claim 1 in which said emblems bear attaching means for removably engaging matching emblems to hold said sheets together to further facilitate making of a bed.

3. The bedding according to claim 2 in which said attaching means include hook and loop fastening means.

4. The bedding according to claim 2 in which said attaching means include snap fastening means.

5. The bedding according to claim 1 in which said emblems have distinctive colors to be matched for further facilitation of making said bed.

6. The bedding according to claim 1 in which one of said sheets is a fitted bottom sheet.

7. The bedding according to claim 1 in which one of said sheets is a comforter.

8. The bedding according to claim 1 in which one of said sheets is a blanket.

* * * * *